United States Patent [19]

Schröter

[11] 4,240,736

[45] Dec. 23, 1980

[54] DEVELOPING APPARATUS FOR DIAZOTYPE MATERIAL, ESPECIALLY FOR USE IN A PHOTOPRINTING MACHINE

[75] Inventor: Herbert Schröter, Taunusstein, Fed. Rep. of Germany

[73] Assignee: Hoechst Aktiengesellschaft, Frankfurt am Main, Fed. Rep. of Germany

[21] Appl. No.: 860,790

[22] Filed: Dec. 15, 1977

[30] Foreign Application Priority Data

Dec. 16, 1976 [DE] Fed. Rep. of Germany ..... 2656901

[51] Int. Cl.[3] ..... G03D 13/00

[52] U.S. Cl. ..... 354/299; 354/300; 34/155

[58] Field of Search ..... 354/299, 300; 34/37, 34/155, 234, 219, 220; 159/13 R, 30, 31

[56] References Cited

U.S. PATENT DOCUMENTS

| | | | |
|---|---|---|---|
| 2,047,104 | 7/1936 | Morse | 354/299 |
| 2,475,165 | 7/1949 | Trump | 354/300 |
| 2,630,744 | 3/1953 | Wilde | 34/234 |
| 3,147,687 | 9/1964 | Halden | 354/299 |
| 3,943,538 | 3/1976 | Hilgers et al. | 354/299 |
| 4,003,069 | 1/1977 | Hilgers | 354/300 |
| 4,062,031 | 12/1977 | Shroter | 354/300 |

FOREIGN PATENT DOCUMENTS

| | | | |
|---|---|---|---|
| 987853 | 3/1965 | United Kingdom | 354/300 |

*Primary Examiner*—L. T. Hix

*Assistant Examiner*—Alan Mathews

*Attorney, Agent, or Firm*—James E. Bryan

[57] ABSTRACT

This invention relates to an improvement in a developing apparatus, especially as part of a photoprinting machine, for developing diazotype copying material capable of being developed by an atmosphere containing gaseous ammonia and water vapor, including a developing chamber comprising at least one first, heated, inclined evaporator trough to which fresh ammonia is adapted to be fed at one side while ammonia water with a reduced ammonia content is adapted to be drained off at the other side, the ammonia water with the reduced ammonia content being adapted to form a pool, and further comprising a siphon through which the ammonia water with the reduced ammonia content and condensate formed in the developing chamber are adapted to be drained off, the improvement that the siphon forms part of an evaporator arranged outside of the developing chamber from which a developer gas pipe leads into the developing chamber, and further comprising a, preferably unheated, reservoir for the ammonia water with the reduced ammonia content adapted to flow from the evaporator trough, the reservoir substantially covering the entire floor space of the developing chamber and being completely open at its top, having an opening which leads to the outside evaporator and being positioned in the chamber at such a level that the bottom of the reservoir is adapted to be completely covered by the pool of ammonia water with reduced ammonia content. The invention also relates to a method of operating the developing apparatus.

10 Claims, 7 Drawing Figures

Figure 1:
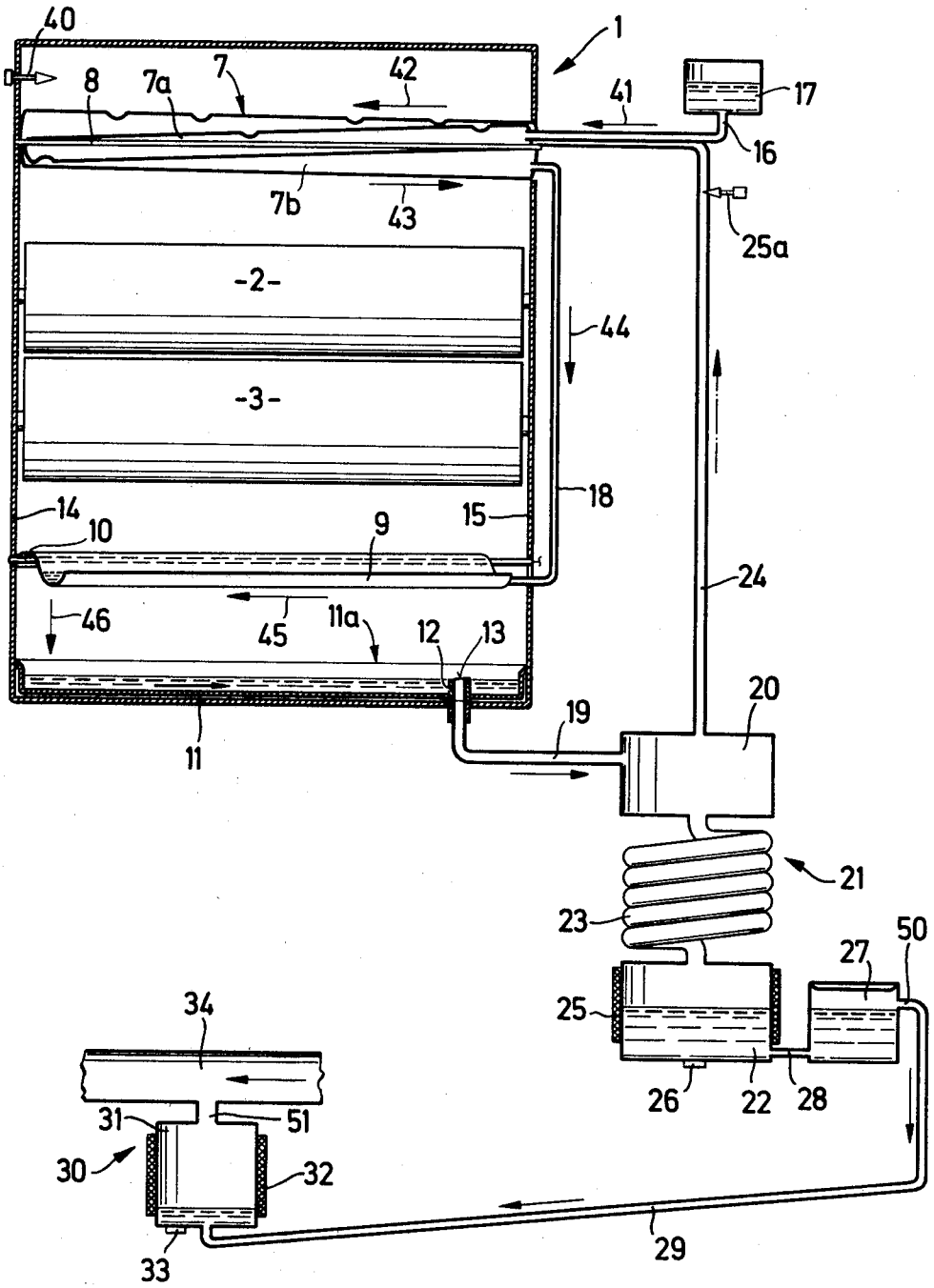

DEVELOPING APPARATUS FOR DIAZOTYPE MATERIAL, ESPECIALLY FOR USE IN A PHOTOPRINTING MACHINE

The present invention relates to a developing apparatus for diazotype material, especially one adapted for use in a photoprinting machine.

In developing apparatus of this type, it is generally desired that the diazotype material to be processed be thoroughly developed at all feed speeds of the material and for all lengths of web possible, consuming as little developer solution as possible. The spent waste water discharged from the developing apparatus should contain as little ammonia as possible, in order to avoid pollution of the environment.

A developing apparatus of this type is known from the prior art and is disclosed in U.S. Pat. No. 3,147,687; it comprises a developing chamber composed of a bottom, side walls, and an upper perforated ceiling over which the diazotype material to be developed is passed. The developing chamber further contains an evaporator with a trough which extends over the entire width of the developing chamber. The trough is inclined from one side wall to the other, so that ammonia water fed into the evaporator flows along the trough. An electric heating element is provided in the trough by which the ammonia water flowing therein is heated. In this manner, part of the ammonia water is evaporated to form gaseous ammonia and water vapor. At the lower end of the trough, the spent ammonia water collects in a small pool. This pool is maintained at the same temperature as the remainder of the trough, i.e. at the temperature at which part of the ammonia water is evaporated. In this manner, care is taken that no gaseous ammonia generated from the ammonia water is absorbed by the pool. In order to remove the spent ammonia water, the lower end of the trough is connected with a vapor trap designed as a siphon. The vapor trap is composed of a vessel into which an open pipe extends from the bottom of the developing chamber. A conduit connecting the end of the trough with the vapor trap ends near the lower, open end of the pipe. The vapor trap has an opening which is arranged at a relatively high level and through which the spent water is discharged. In this arrangement, the condensate drained from the bottom of the developing chamber through the pipe reaching into the vapor trap is also heated to approximately the temperature of the spent ammonia water, so that gaseous ammonia is extracted from the condensate before it is discharged from the developing apparatus as waste water. In this manner, about 93 percent by weight of the ammonia originally contained in the ammonia water is removed. At its junction with the bottom of the developing chamber, the pipe reaching into the vapor trap and provided for discharging the condensate is flush with the bottom, so that no noticeable quantities of condensate can collect on the bottom.

Further, it was found in connection with the just described state of the art that optimum results are obtained with an outside evaporator when the fresh ammonia water has an ammonia concentration of 25 percent by weight and the temperature in the evaporator is maintained at 80° C. (175° F.). In this case, it can be expected that the ammonia concentration in the developing chamber connected with the evaporator is 64 percent by weight and that the developer gas atmosphere contains 36 percent by weight of water vapor.

This applies, however, only if no evaporator trough is in operation in the developing chamber.

It is the object of the present invention to improve the known developing apparatuses in such a manner that they guarantee a complete development of the diazotype material processed, especially photoprinting paper, even in the case of long webs. As little ammonia water as possible should be used for this purpose. In this manner, the quantity of waste water which is discharged from the developing chamber and must be disposed of is reduced. The concentration of ammonia in the waste water should be as low as possible. The developing apparatus used for this purpose should be distinguished by a compact design, and especially the evaporator arranged outside of the developing chamber should be of small size.

This object is achieved, for a developing apparatus of the above described type by the inclusion of an additional evaporator which is arranged outside of the developing chamber and is connected with it. Further, an unheated reservoir, preferably a completely uncovered reservoir, is provided in the developing chamber, in which the ammonia water with reduced ammonia content discharged from the evaporator trough or troughs is collected. The reservoir is so designed that its bottom is covered by ammonia water when the developing chamber is in operation, thus producing a relatively large ammonia water surface. In this manner, care is taken that a relatively large quantity of water is evaporated although the ammonia water in the reservoir is maintained at a relatively low temperature of not more than 60° C. to avoid condensation within the developing chamber. However, it is also possible to heat the reservoir and to provide an additional heating system. Excess water with reduced ammonia content is conducted from the reservoir to the outside evaporator where residual ammonia is virtually completely expelled from the aqueous ammonia solution. Thus, the concentration of ammonia in the waste water discharged from the outside evaporator is only approximately 0.01 percent by weight.

Although it is possible for the not very warm ammonia water with the reduced ammonia content contained in the open reservoir to absorb gaseous ammonia from the atmosphere in the developing chamber, this has no effect practically, because the ammonia is released again in the outside evaporator and is conducted to the developing chamber through the developer gas pipe.

The developing results obtained with the developing apparatus according to the present invention are of surprisingly high quality. The developing results are superior to the developing results obtained, with the same quantity of ammonia water, with a developing apparatus comprising an evaporator trough arranged within the developing chamber, and also the results produced when using a developing apparatus with an evaporator trough arranged within the developing chamber and an outside evaporator connected with the developing chamber. It is not necessary for this purpose to increase the quantity of ammonia water used. The good developing results require only very little additional expenditure, viz. the uncovered reservoir in the developing chamber. This reservoir is composed of a water-tight pan which covers the bottom of the developing chamber and is provided with an outlet whose opening is arranged above the bottom of the pan, so that a quantity of ammonia water may collect which covers the bottom of the pan. It is not necessary, in order to achieve such favorable developing results, to enlarge the outside evaporator and thus produce larger quantities of developer gas. Such an enlargement would be impractical, especially in view of the larger diameters of the pipes and the larger diameter of the helical tube.

Advantageously, the developing apparatus is so designed that the reservoir is arranged at the bottom of the developing chamber in a manner such that it immediately adjoins the side walls of the developing chamber, so that any condensate collecting on the side walls also flows into the reservoir. Further, it is possible to keep the costs for the reservoir especially low, by eliminating a separate pan for the reservoir and only arranging the opening in the water-tight bottom of the developing chamber, which leads to the outside evaporator, in such a manner that ammonia solution with a reduced ammonia content and condensate may collect in a quantity such that the bottom of the developing chamber is covered.

In another advantageous modification of the invention, the developing apparatus comprises guide means for the copying material to be processed. In this modification the reservoir is in the form of a body separate from the bottom of the developing chamber and is arranged above the bottom, under the guide means for the copying material; a socket provided in the reservoir opens above the bottom of the developing chamber; and the bottom is provided with a connecting pipe for the ammonia water with the low ammonia content and the condensate. This modification has the advantage that the reservoir is arranged at a relatively short distance from the web of copying material to be developed. In this manner, the copying material is exposed in a particularly advantageous manner to the action of the developer component released from the large surface of the reservoir, especially water vapor.

Finally, it is possible, as a further modification and if necessary for reasons of construction, to design the developing apparatus in such a manner that the reservoir is a separate body not connected with the bottom and is arranged above the guide means for the copying material to be processed, below the first evaporator trough and above a second evaporator trough, the first evaporator trough above the reservoir being open and a socket which extends into the reservoir being connected to a pipe leading to the second evaporator trough.

In still another embodiment of the invention, which is of particular advantage, the evaporator provided outside of the developing chamber comprises an upper, substantially closed supply tank, a lower, likewise substantially closed evaporator vessel connected with a heating means, and a helical tube—with the axis of the helix substantially vertical—arranged between the upper supply tank and the lower evaporator vessel; a pipe leading to the opening of the reservoir in the developing chamber ends in the supply tank; a developer gas pipe leads from the upper end of the helical tube to the developing chamber; and near the bottom of the evaporator vessel a pipe is attached which leads to a siphon vessel arranged at the same level as the evaporator vessel, the siphon vessel having a discharge opening for excess residual water arranged above the pipe opening, so that the evaporator vessel, the siphon vessel, and the connecting pipe form a siphon.

An outside evaporator of this type is distinguished by relatively low costs and reliable operation, in combination with a relatively compact design. Its purpose is to expel the ammonia as completely as possible from the ammonia solution with the low ammonia content and to convey it to the developing chamber. In combination with the evaporator trough arranged within the developing chamber, the ammonia solution is thus very well utilized with a relatively minor expenditure on construction and energy. The supply tank arranged above the helical tube serves as an intermediate storage tank for the ammonia water and condensate flowing from the developing chamber and causes a uniform and continuous flow of predetermined quantities of liquid through the helical tube. Under the influence of the vapor rising from the evaporator vessel, an exchange of material takes place in the tube, so that ammonia leaves the helical tube in an upward direction and is conducted to the developing chamber, while water, which is almost completely freed from ammonia, flows into the evaporator vessel. The system is gas-tightly sealed from the outside by a siphon formed by the evaporator vessel, the siphon vessel, and the pipe connecting the two with each other.

In order to remove the spent water resulting from the ammonia water after it has been virtually completely freed from ammonia, a waste water evaporator is advantageously attached to the outlet opening of the siphon vessel; and the waste water evaporator is provided with a gas outlet leading to an exhaust air duct. Excess waste water is thus evaporated and may be immediately introduced into the exhaust air duct because of its low ammonia content.

The developing apparatus with the outside evaporator is particularly sturdy if the supply tank, the helical tube, and the evaporator vessel of the evaporator arranged outside of the developing chamber are made of steel. In this manner, the evaporator is not damaged, even if undesirable operational conditions occur which lead to a strong partial heating of the evaporator.

In one embodiment of the developing apparatus of the invention, the feeler gauge of a thermostat is arranged in the developer gas pipe near the developing chamber, the thermostat being connected with the heating means of the evaporator vessel which is in the form of an electrical heating coil. By presetting the desired temperature and determining the actual temperature with the feeler gauge, a thermal power is applied to the evaporator vessel which is sufficient to produce ammonia gas of the desired concentration at the discharge end of the helical tube.

In this connection, it was found to be of advantage to adjust the thermostat to a desired temperature of from 75° to 90° C., preferably 80° C.

According to the present invention, the developing apparatus is preferably operated in such a manner that ammonia solution containing 25 percent by weight of ammonia is fed into the first evaporator trough, that the first and possibly also the second evaporator trough are heated to such a temperature that the ammonia water flowing into the reservoir has a concentration of 10 to 12 percent by weight of ammonia and a temperature of not more than 60° C., that the developer gas flowing from the outside evaporator into the developing chamber has a temperature between 75° and 90° C., preferably of 80° C., and that the temperature within the developing chamber is maintained at 80° to 90° C. It was found that, at these parameters, the best developing results are obtained.

Figure 2:
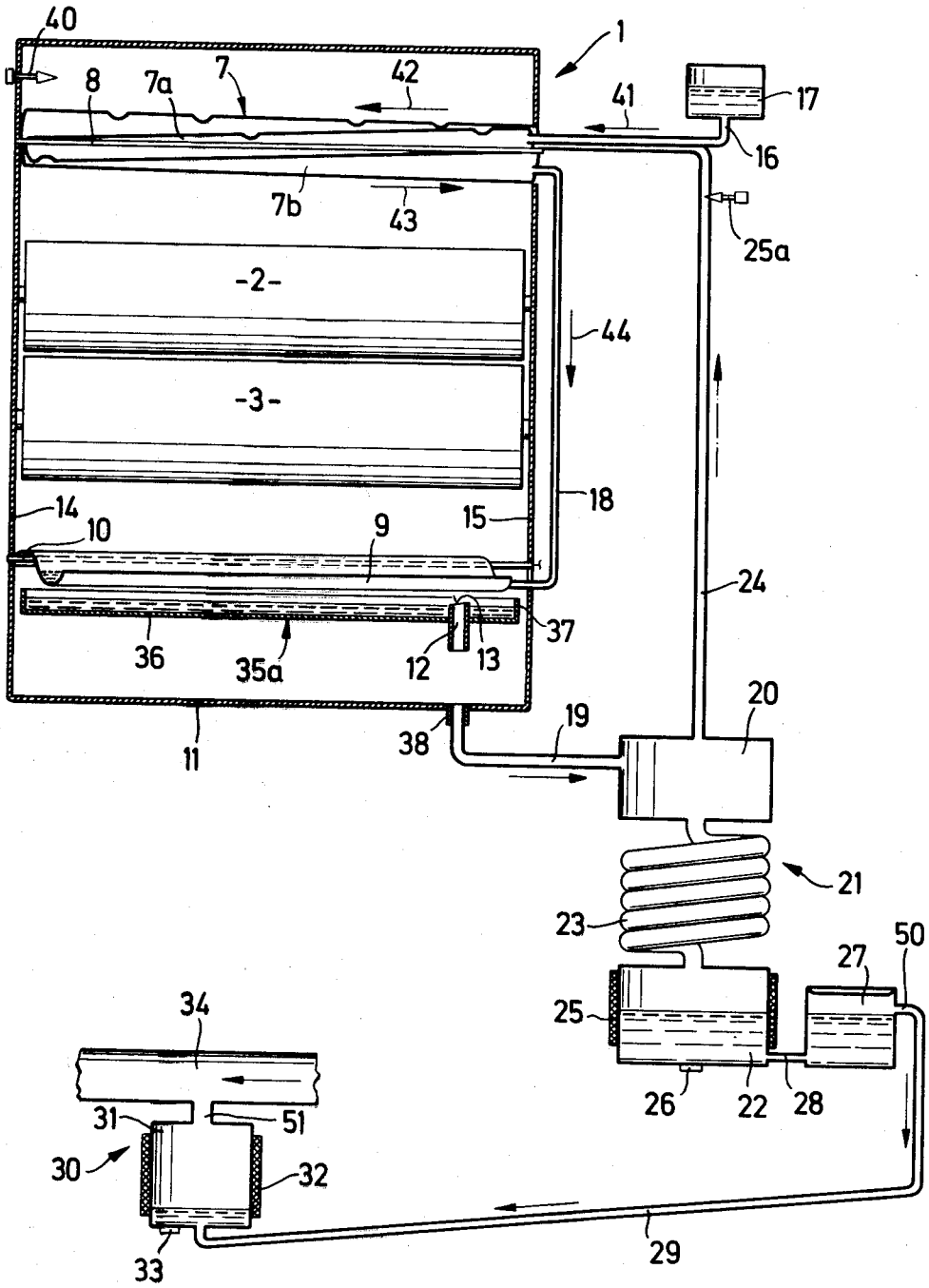
Figure 3:
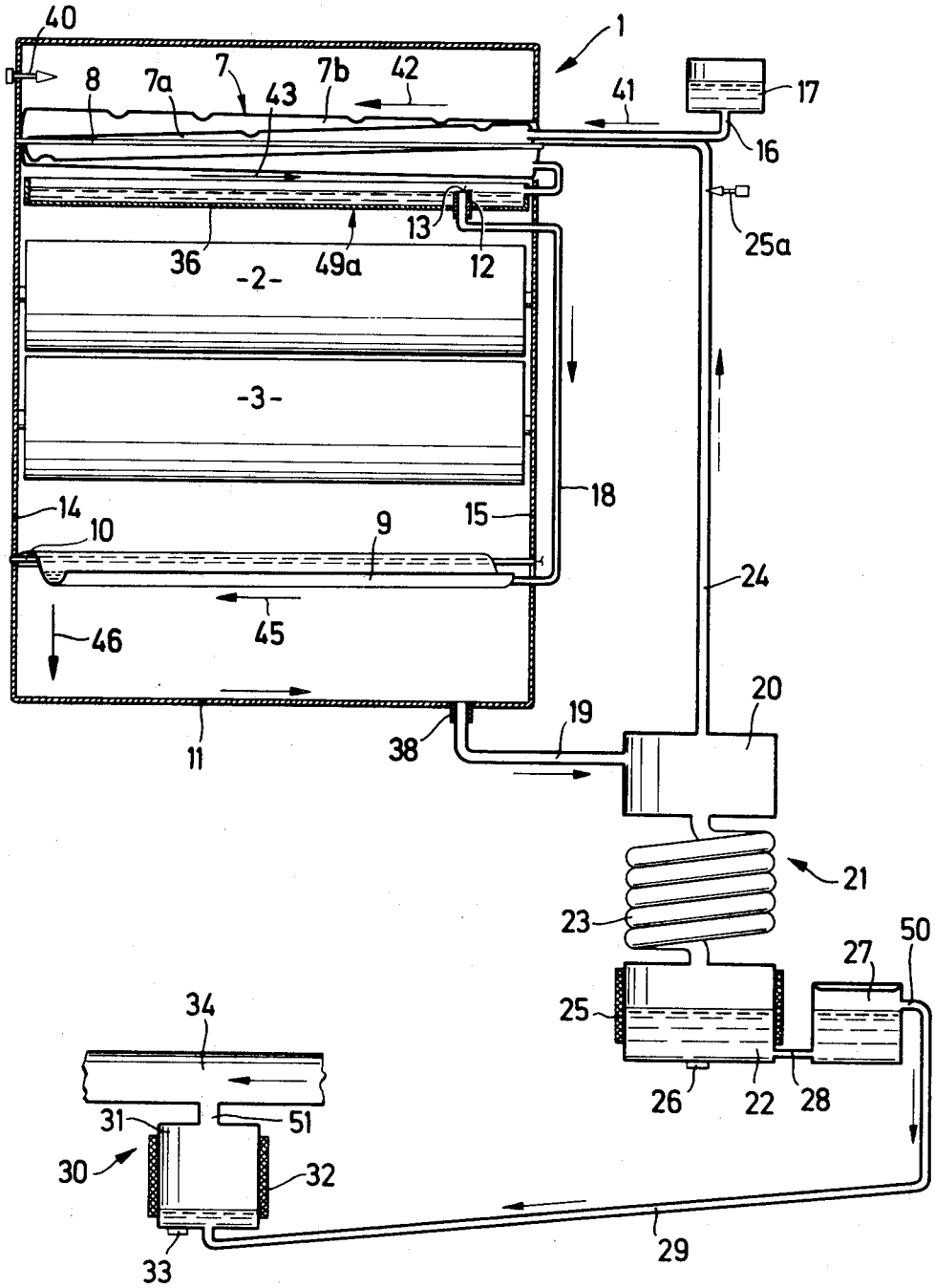
Figure 4:
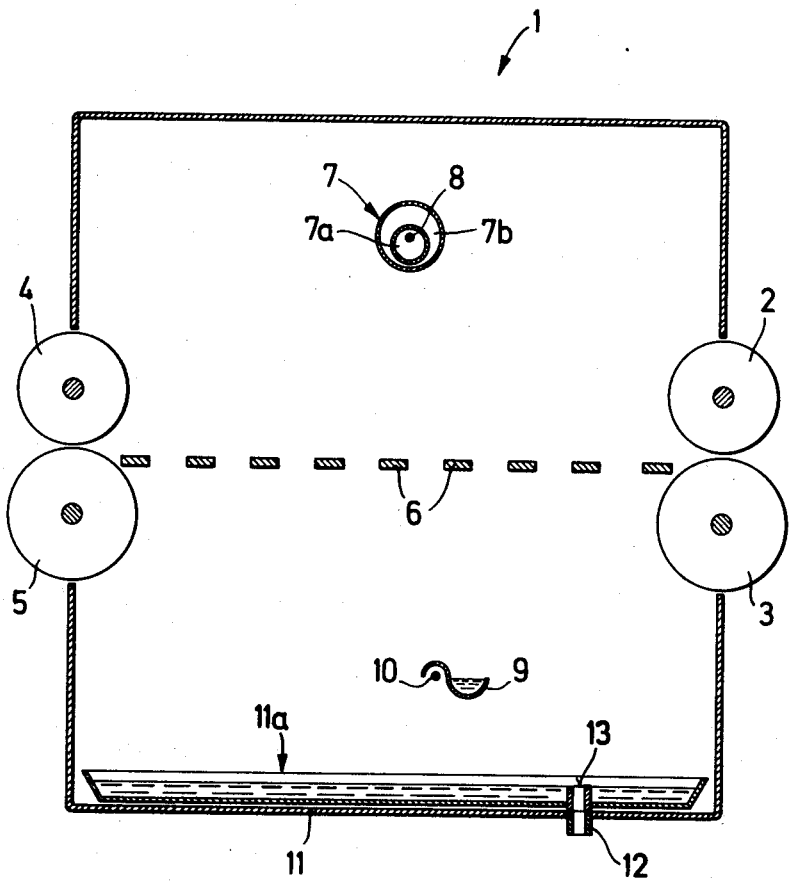
Figure 5:
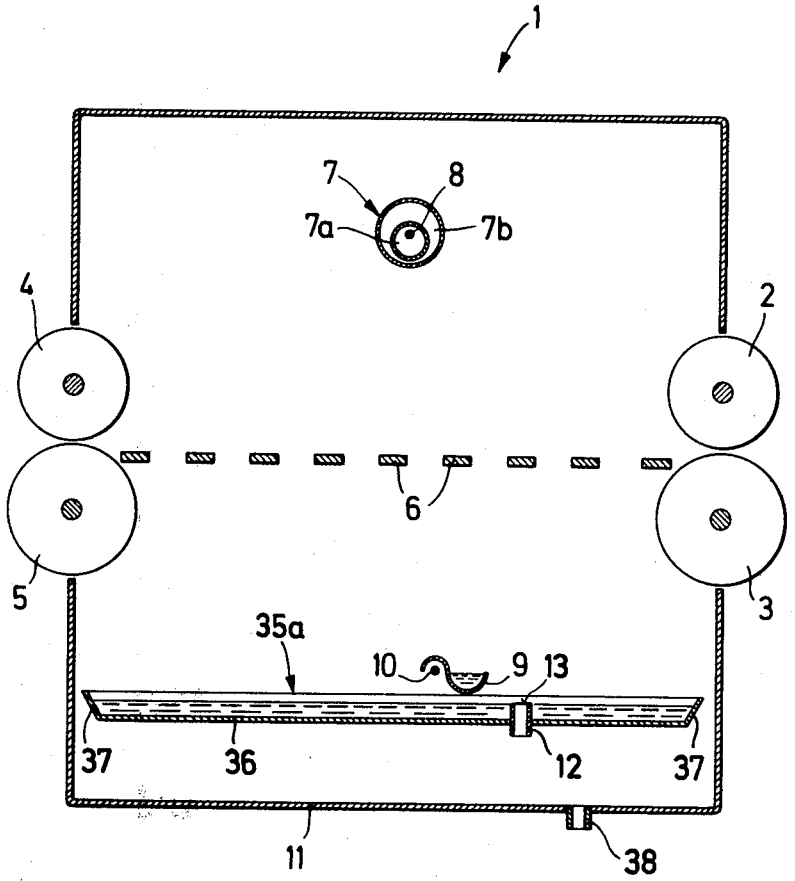
Figure 6:
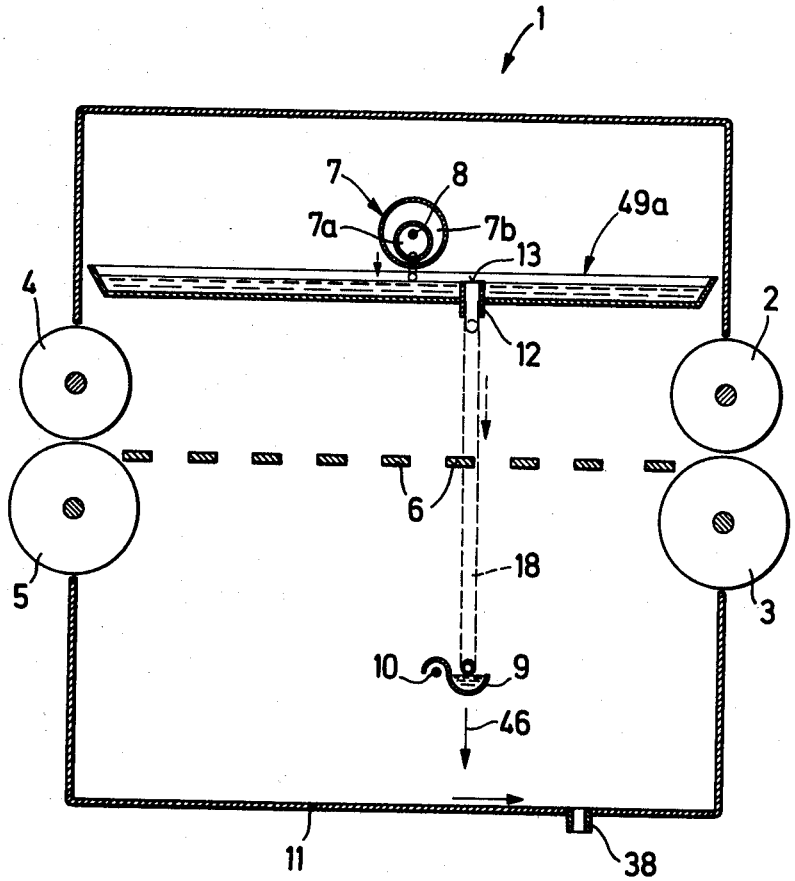
Figure 7:
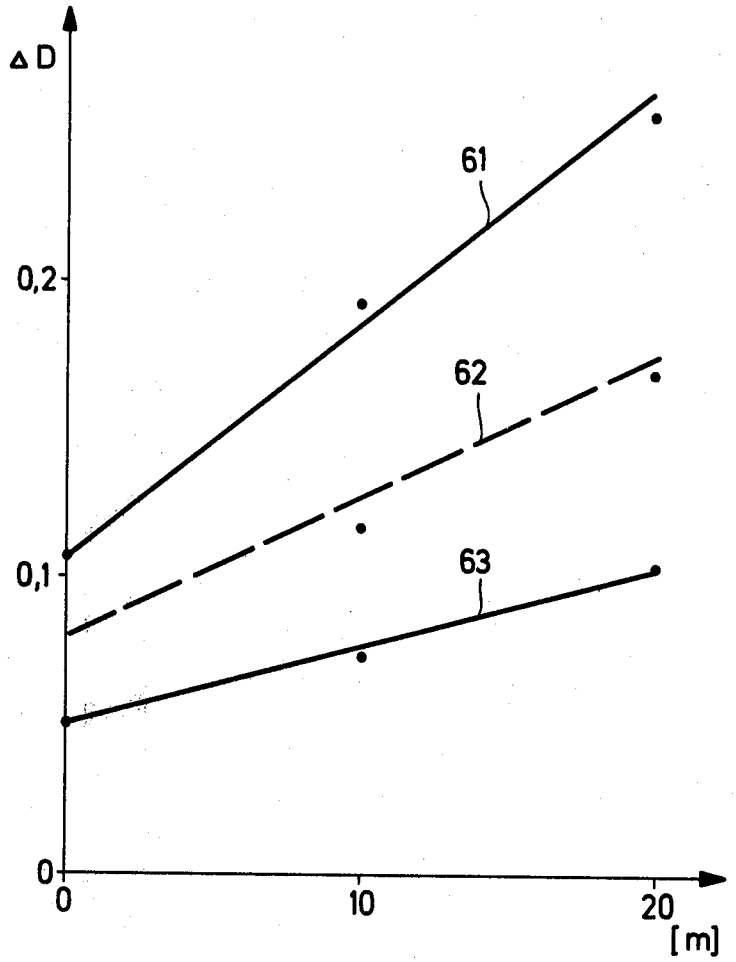

In the following, the invention will be further illustrated by reference to seven figures. Of these:

FIG. 1 shows a front view of a first embodiment of the developing apparatus according to the invention, with the developing chamber being shown in section, FIG. 2 shows a second embodiment of the developing apparatus according to the invention, the view being the same as in FIG. 1, FIG. 3 shows a third embodiment of the developing apparatus according to the invention, the view being the same as in FIGS. 1 and 2, FIG. 4 shows a sectional elevation of the developing chamber according to the first embodiment, FIG. 5 shows a sectional elevation of the developing chamber according to the second embodiment, FIG. 6 shows a sectional elevation of the developing chamber according to the third embodiment of the invention, and FIG. 7 is a diagram showing a comparison between the developing results obtained with the developing apparatus shown in FIGS. 1 and 4 and conventional developing results.

In the figures, identical parts are designated by the same reference numerals.

Numeral 1 designates a developing chamber provided with two pairs of rollers, 2, 3 and 4, 5, for transporting the diazotype copying material to be processed. Further, guide elements 6 for the web of diazotype material are arranged at the level of the roller gaps. Above the guide elements, a first evaporator trough 7 is arranged which essentially is composed of two tubes 7*a* and 7*b* which are fitted into one another and whose upper sides are perforated. The innermost tube 7*a* contains a heating element 8. Below the guide elements 6, a second evaporator trough 9 is arranged which contains a heating element 10.

In FIG. 1, an open reservoir 11*a* is formed on the bottom 11 of the developing chamber. For this purpose, a socket 12 is passed through the bottom whose opening 13 is arranged at a distance from the bottom 11. FIGS. 1 and 4 show that the reservoir covers virtually the whole length and width of the floor space of the developing chamber. The reservoir is so joined to the side walls 14 and 15 of the developing chamber, that any liquid condensing on the side walls flows directly into the reservoir.

In FIG. 1, the trough 7*a* is inclined from right to left, whereas the trough 7*b* slopes downwardly from left to right. The higher end of tube 7*a* is connected with the ammonia water vessel 17 by a connecting pipe 16. The lower end of tube 7*b* is connected, via a tube 18, with the higher end of the second, inclined evaporator trough 9. The lower end of the second evaporator trough 9 is open so that ammonia water flowing from it drops directly into the open reservoir 11.

Another tube 19, which leads to the supply tank 20 of the outside evaporator 21, is connected to the socket 12 in FIG. 1.

In addition to the supply tank 20, the outside evaporator includes a lower evaporator vessel 22 and a helical tube 23 which connects the bottom of the supply tank 20 with the upper portion of the closed evaporator vessel 22. Further, a developer gas pipe 24 leads from the upper opening of the helical tube 23 to the upper portion of the developing chamber 1. Near the point where the developer gas pipe 24 enters the developing chamber 1, there is provided in the developer gas pipe 24 a gauge 25*a* of a thermostat which is connected to a heating element 25 disposed in the evaporator vessel 22. At the bottom of the evaporator vessel, an overheating safeguard 26 is provided which is likewise interposed in the current lead to the heating element 25.

In connection with the outside evaporator 21, a siphon vessel 27 is provided which is connected with the evaporator vessel 22 by means of a pipe 28 above the bottom.

From the siphon vessel 27, a waste water pipe 29 leads to the waste water evaporator 30 which is composed of another evaporator vessel 31 with a heating element 32 attached thereto. An overheating safeguard 33 is again interposed in the current lead to the heating element 32. The evaporator vessel 31 is substantially closed and opens into an exhaust air duct 34 arranged above.

The modification of the developing chamber shown in FIGS. 2 and 5 is distinguished from the earlier described embodiment in that the open reservoir 35*a* is designed as a separate unit, with a bottom 36 and side walls 37, which is independent of the bottom 11 of the developing chamber. In this manner, the reservoir is arranged at a relatively small distance from and below the guide elements 6. The socket 12 whose opening 13 is arranged at a distance above the bottom 36 of the reservoir, extends through the bottom 36 of the reservoir 35*a* and opens onto the bottom 11 of the developing chamber below where a pipe connection 38 is provided. The pipe connection 38 is connected to tube 19 which leads to the supply tank 20 of the evaporator 21.

The embodiment of FIGS. 3 and 6 shows with particularity that the reservoir 49*a* is arranged below the first evaporator troughs 7*a* and 7*b*, but above the path of the diazotype copying material determined by the guide elements 6 and the pairs of rollers 2, 3 and 4, 5. The reservoir 49*a* is open and comprises a bottom 36 and side walls 37 of its own. The socket 12 protruding into the reservoir is connected with its discharge end to the first tube 18, so that a connection is formed between the outlet of the reservoir 49*a* and the entrance of the second evaporator trough 9.

In order to drain condensed water from the developing chamber 1, a pipe connection 38 is provided which leads through the tube 19 to the supply tank 20 of the outside evaporator 21.

Further, a feeler gauge 40 of a thermostat is shown in FIGS. 1 to 3 which is connected to a heating element arranged within the developing chamber, but not shown in the drawings.

As a particular feature, it is pointed out that the open reservoir 11*a* or 35*a* or 49*a*, respectively, requires no additional heating means. If the walls and/or the bottom of the reservoir are connected to a heating element, the temperature of the ammonia water in the reservoir should not exceed 60° C. with the other parameters at which the developing apparatus according to the invention is operated.

The temperature of the first and second evaporator troughs is not controlled. After the apparatus has been started and a waiting time of 20 to 30 minutes has elapsed, only sufficient heating energy is supplied to the apparatus that the ammonia water discharged from the troughs has the desired concentration.

The embodiment of the developing apparatus according to the invention shown in FIG. 1 operates as follows:

The ammonia tank 17 is filled with ammonia water of 25 percent by weight ammonia concentration. The ammonia water flows in the direction of the arrow 41 into the tube 7*a* of the evaporator trough 7 and passes it in the direction of the arrow 42. From there, the ammonia water flows to the tube 18 in the direction of the arrow 43. While the ammonia water passes through the tubes 7*a* and 7*b*, it is heated and evolves water vapor and, above all, gaseous ammonia. The ammonia water with reduced ammonia concentration flows through the tube 18 in the direction of the arrow 44 to the entrance of the second evaporator trough 9. While it is further heated, the ammonia water flows in the second evaporator trough 9 in the direction of the arrow 45 towards the open end of the second evaporator trough 9 and drops from the open end thereof into the open reservoir 11*a* in the direction of the arrow 46. Thus, ammonia water of a relatively low concentration, i.e. 10 to 15 percent by weight, depending on the rate of flow of ammonia water, collects in the reservoir 11*a*.

Further, considerable quantities of developer gas, especially water vapor, are generated in the open reservoirs 11*a*, 35*a*, or 49*a*, because the surfaces of these reservoirs are relatively large. Therefore, no undesirable drop in density occurs, even with relatively long webs, while the diazotype copying material passes the developing chamber.

The ammonia water collected in the reservoir still contains considerable quantities of ammonia. It flows, together with the condensate formed, through the tube 19 into the supply tank 20 from whence it flows through the helical tube 23 of the outside evaporator into the evaporator vessel 22. The evaporator vessel 22 is heated to such an extent that water vapor is generated and rises in the helical tube 23. As a consequence of the close contact between the ammonia water flowing downwards in the helical tube and the rising vapor, an exchange of material takes place.

Thus, a developer gas with a high content of gaseous ammonia rises in the helical tube and is conducted to the developing chamber through the developer gas pipe 24. On the other hand, water which is substantially free from ammonia flows into the evaporator vessel 22. The evaporator vessel is heated in accordance with the actual temperature determined by the feeler gauge 25*a* of a thermostat and the adjusted desired temperature of the developer gas. With a developer gas temperature of from 80° to 90° C., the proportion of ammonia gas in the developer gas is relatively high, as determined by the partial pressures of ammonia and water. On the other hand, the ammonia water flowing down the helical tube 23 is substantially freed from ammonia when it reaches the evaporator vessel 22. Actually, the ammonia water contained in the evaporator vessel 22 has an ammonia content of only 0.02 percent by weight, and the unevaporated portion thereof which flows through the pipe 28, the siphon vessel 27, the opening 50, and the waste water pipe 29 into the waste water evaporator 30 may be completely evaporated in the waste water evaporator 30 and introduced through the opening into the exhaust air duct 34 without risking pollution.

The effect produced by the developer apparatus according to the invention is that the quantity of water passing per unit of time from the liquid into the gaseous phase in the developing chamber is relatively large, because of the large surface of the reservoir. Further, additional quantities of developer gas are introduced into the developing chamber from the outside evaporator. The temperature of the developer gas fed to the developing chamber through the pipe 24 is adjusted such that no significant condensation occurs in the developing chamber.

The water vapor generated by the open reservoir has a buffer effect in that even relatively long webs of material to be developed do not display an undesirable loss in density, even if no large quantities of fresh ammonia water are added. Because of the relatively small quantities of ammonia water used and the very low ammonia content of the waste water, waste water can be removed without environmental problems.

The embodiments of the invention shown in FIGS. 2 and 3 operate in a manner similar to that shown in FIG. 1, with the exception that in FIG. 2 the ammonia water with the low ammonia concentration first flows from the evaporator trough to the bottom of the developer chamber before it leaves the developing chamber together with the condensate which may have formed, and that, in FIG. 3, the ammonia water with the reduced ammonia concentration flows from the first evaporator trough 7*a*, 7*b* into the reservoir and from there into the second evaporator.

FIG. 7 illustrates the outstanding developing performance of the apparatus according to the invention, as compared with comparable developing apparatus operating either without an outside evaporator, or with an outside evaporator, but without an open reservoir in the developing chamber containing ammonia water with a reduced ammonia content. In FIG. 7, the web length of a continuous web of diazotype copying material is plotted as the abscissa. The ordinate shows the density difference D obtained by subtracting the density of a sample conveyed through the developing chamber at a speed of 8 m/min. from the density of a sample fed through the developing chamber at a speed of 1 m/min. The smaller the density difference, the more uniform are, in principle, the developing results obtained.

The upper curve, 61, of FIG. 7, which illustrates the developing results obtained with a developing apparatus having no outside evaporator and no reservoir in the developing chamber, shows that the difference in density is relatively great even with the shortest web length. With increasing web lengths, the density difference increases considerably and corresponds to the inclination of the characteristic curve.

Curve 62, which illustrates the results obtained with a developing apparatus comprising an outside evaporator, but no reservoir within the developing chamber, shows a reduction of the difference in density for all web lengths.

Curve 63, which illustrates the developing results obtained with an embodiment of the developing apparatus as shown in FIGS. 1 and 4, shows that excellent results are obtained by the invention, because even with the shortest webs the difference in density is minimal and increases considerably less with increasing web lengths than with other developing apparatuses.

It will be obvious to those skilled in the art that many modifications may be made within the scope of the present invention without departing from the spirit thereof, and the invention includes all such modifications.

What is claimed is:

1. In a developing apparatus for developing diazotype copying material capable of being developed by an atmosphere containing gaseous ammonia and water vapor, including a developing chamber comprising at least one first, heated, inclined evaporator trough to which fresh ammonia is adapted to be fed at one side while ammonia water with a reduced ammonia content is adapted to be drained off at the other side, the ammonia water with the reduced ammonia content being adapted to form a pool, and further comprising a siphon through which the ammonia water with the reduced ammonia content and condensate formed in the developing chamber are adapted to be drained off, the improvement that the siphon forms part of an evaporator arranged outside of the developing chamber from which a developer gas pipe leads into the developing chamber, a heated reservoir for the ammonia water with the reduced ammonia content adapted to flow from the evaporator trough, the reservoir substantially covering the entire floor space of the developing chamber and being completely open at its top, having an opening which leads to the outside evaporator and being positioned in the chamber at such a level that the bottom of the reservoir is adapted to be completely covered by the pool of ammonia water with reduced ammonia content, guiding means for the copying material to be developed, and said reservoir being designed as a body which is separate from the bottom of the developing chamber and is positioned above the bottom of the developing chamber and below the guiding means for the copying material; further including a socket in the reservoir and opening above the bottom of the reservoir, and a pipe connection in the bottom of the developing chamber for the ammonia water with the reduced ammonia content and for condensate.

2. A developing apparatus according to claim 1 including means connecting the discharge opening of the siphon vessel with a waste water evaporator which has a vapor outlet leading to an exhaust air duct.

3. A developing apparatus according to claim 1 in which the supply tank, the helical tube, and the evaporator vessel of the evaporator positioned outside the developing chamber are made of steel.

4. A developing apparatus according to claim 1 including a feeler gauge of a thermostat positioned in the developer gas pipe near the developing chamber, said feeler gauge being connected with the heating element of the evaporator vessel which is in the form of an electric heating coil.

5. A developing apparatus according to claim 4 in which the thermostat is adjusted to a value of 75° to 90° C., preferably to 80° C.

6. Developing apparatus according to claim 1 in which the reservoir for the ammonia water with the reduced ammonia content adapted to flow from the evaporator trough is unheated.

7. In a developing apparatus for developing diazotype copying material capable of being developed by an atmosphere containing gaseous ammonia and water vapor, including a developing chamber comprising at least one first, heated, inclined evaporator trough to which fresh ammonia is adapted to be fed at one side while ammonia water with a reduced ammonia content is adapted to be drained off at the other side, the ammonia water with the reduced ammonia content being adapted to form a pool, and further comprising a siphon through which the ammonia water with the reduced ammonia content and condensate formed in the developing chamber are adapted to be drained off, the improvement that the siphon forms part of an evaporator arranged outside of the developing chamber from which a developer gas pipe leads into the developing chamber, a heated reservoir for the ammonia water with the reduced ammonia content adapted to flow from the evaporator trough, the reservoir substantially covering the entire floor space of the developing chamber and being completely open at its top, having an opening which leads to the outside evaporator and being positioned in the chamber at such a level that the bottom of the reservoir is adapted to be completely covered by the pool of ammonia water with reduced ammonia content, said evaporator provided outside of the developing chamber comprising an upper, substantially closed supply tank, a lower, also substantially closed evaporator vessel connected to a heating element, and a helical tube with the axis of the helix substantially vertical between the upper supply tank and the lower evaporator vessel; a conduit leading to the opening of the reservoir in the developing chamber and opening into the supply tank; a developer gas pipe leading from the upper end of the helical tube to the developing chamber; and a pipe attached to the evaporator vessel near the bottom thereof, said pipe leading to a siphon vessel positioned at the same level as the evaporator vessel and having an opening for excess waste water at a level above the connecting pipe, whereby the evaporator vessel, the siphon vessel, and the connecting pipe together form a siphon.

8. In a developing apparatus for developing diazotype copying material capable of being developed by an atmosphere containing gaseous ammonia and water vapor, including a developing chamber comprising at least one first, heated, inclined evaporator trough to which fresh ammonia is adapted to be fed at one side while ammonia water with a reduced ammonia content is adapted to be drained off at the other side, the ammonia water with the reduced ammonia content being adapted to form a pool, and further comprising a siphon through which the ammonia water with the reduced ammonia content and condensate formed in the developing chamber are adapted to be drained off, the improvement that the siphon forms part of an evaporator arranged outside of the developing chamber from which a developer gas pipe leads into the developing chamber, a heated reservoir for the ammonia water with the reduced ammonia content adapted to flow from the evaporator trough, the reservoir substantially covering the entire floor space of the developing chamber and being completely open at its top, having an opening which leads to the outside evaporator and being positioned in the chamber at such a level that the bottom of the reservoir is adapted to be completely covered by the pool of ammonia water with reduced ammonia content, guiding means for the copying material to be developed and said reservoir being positioned above the guiding means, below the first evaporator trough and above a second evaporator trough, said first evaporator trough being open above the reservoir, and including a socket in the reservoir connected to a pipe leading to the second evaporator trough.

9. A method of operating the developing apparatus claimed in claim 8 comprising feeding ammonia water with an ammonia concentration of 25 percent by weight into the first evaporator trough; heating the first evaporator trough to a temperature sufficiently high that the residual ammonia water flowing into the reservoir has an ammonia concentration of not more than 10 to 12 percent by weight and a temperature of not more than 60° C.; maintaining the developer gas flowing from the outside evaporator into the developing chamber at a temperature between 75° and 90° C., preferably 80° C.; and maintaining the temperature within the developing chamber between 80° and 90° C.

10. A method according to claim 9 including heating the second evaporator trough to a temperature sufficiently high that the residual ammonia water flowing into the reservoir has an ammonia concentration of not more than 10 to 12 percent by weight and a temperature of not more than 60° C.

* * * * *